US007624569B2

(12) United States Patent
Driscoll et al.

(10) Patent No.: US 7,624,569 B2
(45) Date of Patent: Dec. 1, 2009

(54) ENGINE SYSTEM INCLUDING MULTIPE ENGINES AND METHOD OF OPERATING SAME

(75) Inventors: Josh Driscoll, Dunlap, IL (US); Wade J. Robel, Peoria, IL (US); Jason Bloms, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 538 days.

(21) Appl. No.: 11/242,316

(22) Filed: Oct. 3, 2005

(65) Prior Publication Data

US 2007/0074504 A1 Apr. 5, 2007

(51) Int. Cl.
*F01N 3/00* (2006.01)

(52) U.S. Cl. ..... 60/285; 60/274; 60/301

(58) Field of Classification Search ..... 60/274, 60/285, 286, 295, 299, 301
See application file for complete search history.

(56) References Cited

U.S. PATENT DOCUMENTS

| | | | | |
|---|---|---|---|---|
| 5,528,901 | A * | 6/1996 | Willis | 60/626 |
| 5,964,088 | A * | 10/1999 | Kinugasa et al. | 60/286 |
| 6,047,542 | A * | 4/2000 | Kinugasa et al. | 60/274 |
| 6,244,043 | B1 | 6/2001 | Farmer et al. | |
| 6,289,672 | B1 | 9/2001 | Katoh et al. | |
| 6,336,320 | B1 | 1/2002 | Tanaka et al. | |
| 6,536,209 | B2 * | 3/2003 | Fluga et al. | 60/285 |
| 6,666,020 | B2 * | 12/2003 | Tonetti et al. | 60/286 |
| 6,843,055 | B2 | 1/2005 | Ootake | |
| 6,872,365 | B1 * | 3/2005 | Boegner et al. | 422/174 |
| 7,017,339 | B2 * | 3/2006 | Konstantakopoulos et al. | 60/323 |
| 7,216,480 | B2 * | 5/2007 | Suzuki et al. | 60/285 |
| 2005/0025692 | A1 | 2/2005 | Becher et al. | |
| 2006/0096275 | A1 | 5/2006 | Robel et al. | |

OTHER PUBLICATIONS

Hamada, Kato, Imada, Kikkawa and Yamada; A Unique Titania-Based SCR NOx Catalyst For Diesel Exhaust Emission Control; Apr. 2005; pp. 1-7; SAE International; Detroit, Michigan.

Ogunwumi, Fox, Patil and He; In-Situ $NH_3$ Generation For SCR $NO_x$ Applications; Oct. 2002; pp. 1-6; SAE International; San Diego, California.

* cited by examiner

*Primary Examiner*—Thomas E Denion
*Assistant Examiner*—Diem Tran
(74) *Attorney, Agent, or Firm*—Liell & McNeil

(57) ABSTRACT

Engines that include different combustion strategies for different cylinders may create a power imbalance resulting in undesirable engine vibrations. The engine system of the present disclosure includes a first engine that is operable to produce a high NOx concentration exhaust and a second engine that is operable to produce a low NOx concentration exhaust. The first engine is fluidly connected to a first section of an exhaust passage and the second engine is fluidly connected to a second section of the exhaust passage. The exhaust from the first engine and the exhaust from the second engine are merged in a merged section of the exhaust passage downstream from both the first and second sections of the exhaust passages. The high NOx concentration exhaust may be converted to ammonia for reacting with the low NOx concentration exhaust to arrive at very low NOx concentration from the merged exhaust.

20 Claims, 6 Drawing Sheets

ENGINE SYSTEM INCLUDING MULTIPE ENGINES AND METHOD OF OPERATING SAME

TECHNICAL FIELD

The present disclosure relates generally to engine systems with multiple engines, and more specifically to combining exhaust passages from the multiple engines within an engine system for exhaust purification.

BACKGROUND

In order to meet increasingly stringent federal regulations of NOx and other undesirable emissions, engineers are constantly seeking new strategies of reducing the undesirable emissions. One method of reducing NOx emissions is NOx selective catalytic reduction (SCR) systems. These systems use ammonia ($NH_3$) to reduce NOx to nitrogen ($N_2$) and water. Although these systems can reduce NOx emissions, NOx selective catalytic reduction systems often require ammonia storage on the vehicle. Ammonia tanks can consume valuable space within the engine system and must be replenished periodically. Further, because of the high reactivity of ammonia, on-board storage of the ammonia can be hazardous.

Some of the drawbacks associated with the use of NOx selective catalysts can be eliminated by the use of on-board ammonia generation systems. For instance, the on-board ammonia production system set forth in U.S. Pat. No. 6,047,542, issued to Kinugasa on Apr. 11, 2000, injects an increased amount of fuel into one cylinder group within a plurality of cylinders in order to create a rich exhaust from the one cylinder group. The rich exhaust is then passed over an ammonia-producing catalyst that converts a portion of the NOx in the rich exhaust into ammonia. It has been found that the efficiency of conversion of NOx to ammonia by the ammonia-producing catalyst may be improved under rich conditions. The exhaust and the ammonia is then combined with the exhaust from a second cylinder group and passed through a SCR catalyst where the ammonia reacts with NOx to produce nitrogen gas and water.

Although the Kinugasa method allows for on-board generation of ammonia, the different operations of the cylinders can create drawbacks. For instance, an engine may function less efficiently and with lower power output when rich combustion occurs in a portion of the cylinders. Moreover, the two cylinder groups, operating in the Kinugasa method, may cause significant power imbalance within the engine, resulting in engine vibrations.

The present disclosure is directed at overcoming one or more of the problems set forth above.

SUMMARY OF THE INVENTION

In one aspect of the present disclosure, an engine system includes at least a first engine that is operable to produce a high NOx concentration exhaust and a second engine that is operable to produce a low NOx concentration exhaust. The first engine is fluidly connected to a first section of an exhaust passage, and the second engine is fluidly connected to a second section of the exhaust passage. The first section and the second section are fluidly connected to a merged section that is downstream from the first section and the second section.

In another aspect of the present disclosure, an engine system is operated by generating exhaust with a high NOx concentration from a first engine and a generating exhaust with a low NOx concentration from a second engine. The exhaust with the high NOx concentration is merged with the exhaust with the low NOx concentration.

DETAILED DESCRIPTION

Figure 1:
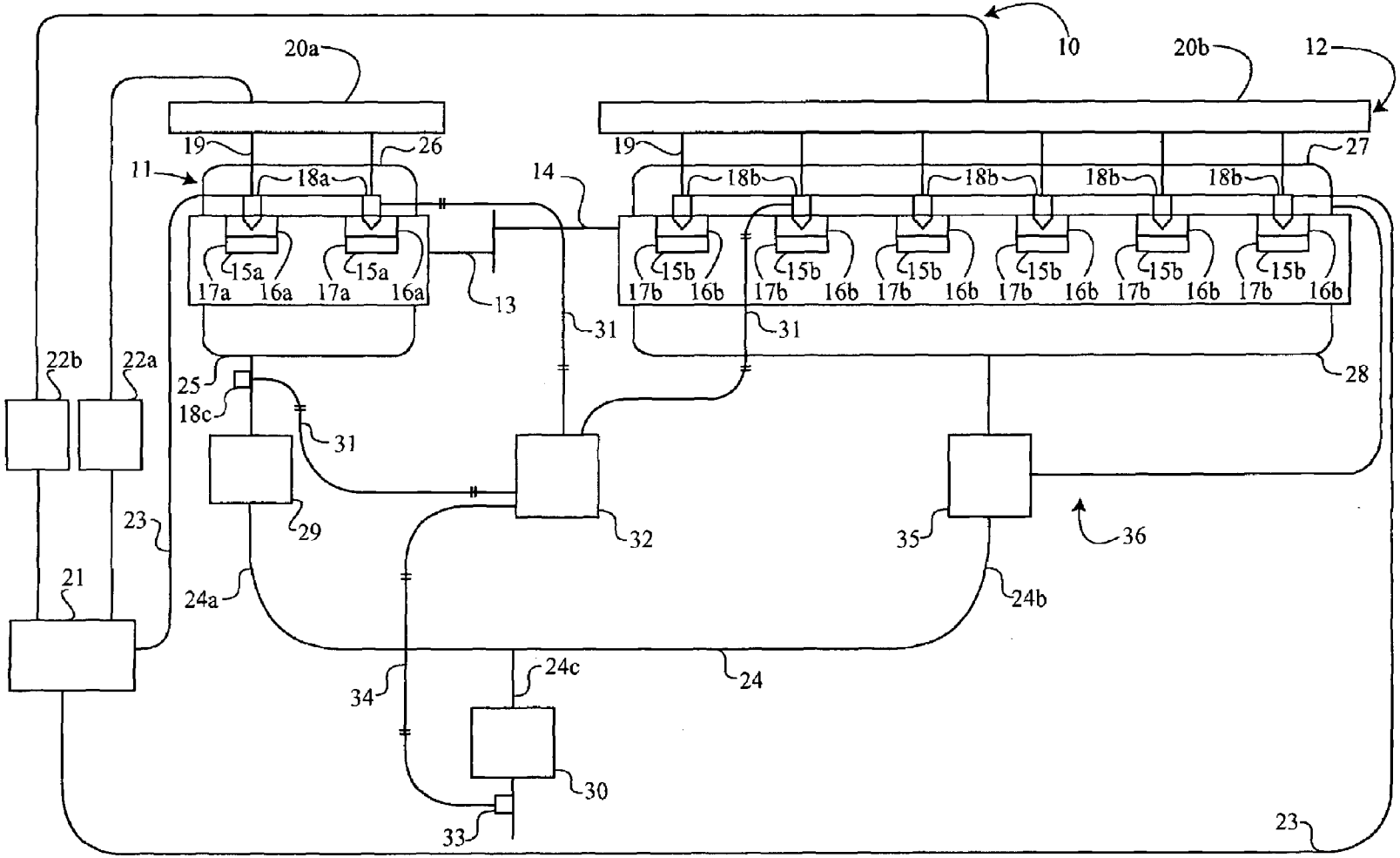
FIG. 1 is a schematic representation of an engine system, according to a first embodiment of the present disclosure.

Referring to FIG. 1, there is shown a schematic representation of an engine system 10, according to a first embodiment of the present disclosure. The engine system 10 includes a first engine 11 operable to produce a high NOx concentration 65 (illustrated in FIG. 6) and a second engine 12 operable to produce a low NOx concentration 37 (illustrated in FIG. 6). Although the present disclosure is illustrated as including only two engines 11 and 12, it should be appreciated that the engine system could including any number of engines, as long as at least one engine produces exhaust with the high NOx concentration and at least one engine produced exhaust with the low NOx concentration. In the illustrated embodiment, the first engine 11 may be a low displacement engine, and the second engine 12 may be a high displacement engine.

The first engine 11, being the low displacement engine, may include various types of engines, including but, not limited to, a Stirling-cycle engine, a free-piston engine and a conventional two-stroke or four-stroke internal combustion engine. Preferably, the first engine 11 is a conventional internal combustion engine, such as a direct injection diesel or spark ignited engine. Although the engine 11 could include any number of cylinders, in the illustrated embodiment, the first engine 11 includes two cylinders 15*a* defining two combustion chambers 16*a*. A fuel injector 18*a* is partially positioned within each combustion chamber 16*a* in which a piston 17*a* reciprocates. In the illustrated embodiment, an additional fuel injector 18*c* is positioned to inject fuel within a first section 24*a* of an exhaust passage 24 fluidly connected to the combustion chambers 16*a*. Although the second engine 12, being the high displacement engine, may include various types of engines, the second engine 12 is preferably also a conventional internal combustion engine. Although the number of cylinders could vary, in the illustrated embodiment, the second engine 12 includes six cylinders 15*b* defining six combustion chambers 16*b*. A fuel injector 18*b* is partially positioned within each combustion chamber 16*b* in which a piston 17*b* reciprocates. Each of the illustrated nine fuel injectors 18*a*, 18*b* and 18*c* is in electrical communication with an electronic control module 32 via respective injection communication lines 31. Thus, the injection strategies of each fuel injector can be separately controlled by the electronic control module 32. Although only one electronic control module 32 including control algorithms is illustrated, it should be appreciated that there could be more than one electronic control modules between which the control algorithms of the engine system are divided.

Fuel is supplied to the fuel injectors 18*a* and 18*b* of the first and second engines 11 and 12 from a first common rail 20*a* and a second common rail 20*b*, respectively, via individual branch passages 19. Fuel is delivered from a fuel tank 21 via at least one conventional fuel pump 22*a* to the first common rail 20*a* and via at least another conventional fuel pump 22*b* to the second common rail 20*b*. The conventional fuel pumps 22*a* and 22*b* are preferably in communication with the electronic control module 32 such that the pumps 22*a* and 22*b* can vary the pressure of the fuel being supplied to the common rails 20*a* and 20*b*, respectively. Although each engine 11 and 12 is illustrated as including a pump 22*a*, 22*b* and a common rail 20*a*, 20*b* so that the pressure of the fuel being supplied to the fuel injectors 18*a* and 18*b* can be separately controlled, it should be appreciated that the engines could share one fuel pump and one common rail. Fuel not injected into the combustion chambers 16*a*, 16*b* via the fuel injectors 18*a*, 18*b* can be returned to the fuel tank 21 via return lines 23 fluidly connecting the fuel injectors 18*a*, 18*b* to the fuel tank 21.

In the first embodiment, a first power output 61 (illustrated in FIG. 6) of the first engine 11 and a second power output 62 (illustrated in FIG. 6) of the second engine 12 are coupled to a common power output by coupling a first output shaft 13 of the first engine 11 to a second output shaft 14 of the second engine 12. The first output shaft 13 can be coupled to the second output shaft 14 in any conventional manner, including, but not limited to, a coupling gear train. Although not shown, the rotation of the second outputs shaft 14 may power a primary apparatus, such as a drive shaft and/or hydraulic implement of a work machine or a generator. For instance, the first engine 11 could be used for stationary power generation on a vehicle. It should be appreciated that the first engine 11 and the second engine 12 can be coupled to one another by any other conventional means, including, but not limited to, hydraulic couplings and electric couplings. The power outputs 61 and 62 could also be kept separate, with the first engine 11 supplying power to auxiliary systems that support the second engine 12, or elsewhere such as an HVAC or other electric hybrid system. The first engine 11 could also be used in regenerated power the could be put back into the drive line, used to electrically regenerate a particulate matter trap or other NOx/hydrocarbon catalysts, used in electro turbo compounding, or any other assisted power need that those skilled in the art might consider in relation to a high voltage line being created.

Apart from merging the respective power outputs of the first and second engines, the two engines could also share a common coolant supply system and lines, a common oil supply system and lines, a common oil supply system and lines, as well as distributed electronics. In addition, the first and second engines could be physically attached or built into a common block to take advantage of space saving which also may allow for the elimination of some fluid lines, sensors, pumps, etc. Even if the two engines shared a common block, they could be different types of engines, for instance, the first engine could be a free piston engine, while the second engine could be a conventional four cycle diesel engine. Those skilled in the art can imagine numerous other alternatives, such as replacing the oil pan of the second engine 12 with the low displacement engine and relocating an oil pump system into a side of the engine block for the second engine 12.

The combustion chambers 16*a* and 16*b* of the first and second engines 11 and 12 are fluidly connected to a first air intake manifold 26 and a second air intake manifold 27, respectively. The combustion chambers 16*a* of the first engine 11 are in fluid communication with the first section 24*a* of the exhaust passage 24 via a first exhaust manifold 25. The combustion chambers 16*b* of the second engine 12 are in fluid communication with a second section 24*b* of the exhaust passage 24 via a second exhaust manifold 28. The first section 24*a* and the second section 24*b* are fluidly connected to a merged section 24*c* of the exhaust passage 24 that is downstream from the first and second sections 24*a* and 24*b*.

Preferably, the second engine 12 includes a forced-induction system 36 to increase power output and/or control the air to fuel-vapor ratios within the combustion chambers 16*b* of the second engine 12. In the illustrated embodiment, the forced induction system 33 includes a turbocharger 35 operably connected with the second air-intake manifold 27. The turbocharger 35 utilizes the exhaust in the second section 24*b* of the exhaust passage 24 to generate power for a compressor, and this compressor may provide additional air to the second air-intake manifold 27. Although not shown, those skilled in the art should appreciate that the compressor could also provide air to the first air-intake manifold 26 of the first engine 11. It should also be appreciated that the forced induction system 36 may include superchargers and/or be turned on and off based on demand. For instance, when lower air-intake is needed, such as when little power is needed from the second engine 12, the combustion chambers 16*b* of the second engine 12 can be naturally aspirated.

A reductant-producing catalyst 29, herein referred to as an ammonia-producing catalyst, is positioned within the first section 24*a* of the exhaust passage 24. The ammonia-producing catalyst 29 is operable to convert at least a portion of the exhaust-gas stream from the first engine 11 into ammonia, or possibly some other higher order reductant. The ammonia may be produced by a reaction between NOx and other substances in the exhaust-gas stream from the first engine 11. For example, NOx may react with a variety of other combustion byproducts to produce ammonia and other related reductants. These other combustion byproducts may include, for example, $H_2$ (hydrogen gas), $C_3H_6$ (propene), or CO (carbon monoxide). This disclosure also contemplates reductant (ammonia) reproduction by serially passing the NOx over several different catalyst, with the end result being ammonia and/or another suitable reductant.

The ammonia-producing catalyst 29 may be made from a variety of materials. In one embodiment, ammonia-producing catalyst 29 may include at least one of platinum, palladium, rhodium, iridium, copper, chrome, vanadium, titanium, iron, or cesium. Combinations of these materials may be used, and the catalyst material may be chosen based on the type of fuel used, the air to fuel-vapor ratio desired, or for conformity with environmental standards and other known considerations.

A NOx selective catalyst 30 is positioned in the merged section 24*c* of the exhaust passage 24 such that combined exhaust from the first engine 11, including the ammonia, and the exhaust from the second engine 12 all pass over the NOx selective catalyst 30. In one embodiment, the NOx selective catalyst 30 may facilitate reactions between ammonia and NOx to at least partially remove NOx from the exhaust-gas stream in the merged section 24*c* of the exhaust passage 24. For example, the NOx selective catalyst 30 may facilitate a reaction between ammonia and NOx to produce nitrogen gas and water, among other reaction products. A NOx sensor 33 is preferably positioned within the merged section 24*c* of the exhaust passage 24 downstream from the NOx selective catalyst 30, and is in communication with the electronic control module 32 via a sensor communication line 34. The illustrated NOx sensor 33 is a conventional sensor that is readily commercially available and operable to sense both a NOx concentration and ammonia concentration within the exhaust. Other strategies for sensing or predicting NOx concentrations may be available. For instance, additional NOx sensors might also be positioned in respective exhaust passages 24*a* and 24*b* to provide additional useful information to the ECM 32.

It should be appreciated that a variety of additional catalysts and/or filters may be included in the exhaust passage 24, including, but not limited to, particulate filters, NOx traps, and/or three-way catalysts. For clarity, many of the these features have not been shown, but would be included. For instance, even the low displacement engine 11 might include an auxiliary regeneration device and a particle trap in its exhaust passage 24*a*, and a second auxiliary regeneration device and particle trap would likely be included in exhaust passage 24*b* for the second engine 12. For instance, in the illustrated embodiment, an oxidation catalyst can be positioned within the now NOx section 24*b* downstream from turbocharger 38 and upstream from the merged section 24*c* and the NOx selective catalyst 30. Because the NOx selective catalyst 30 functions most effectively with a ratio of $NO:NO_2$ of about 1:1, the oxidation catalyst is operable to control a ratio of $NO:NO_2$ in the merged section 24*c* of the exhaust passage 24.

Figure 2:
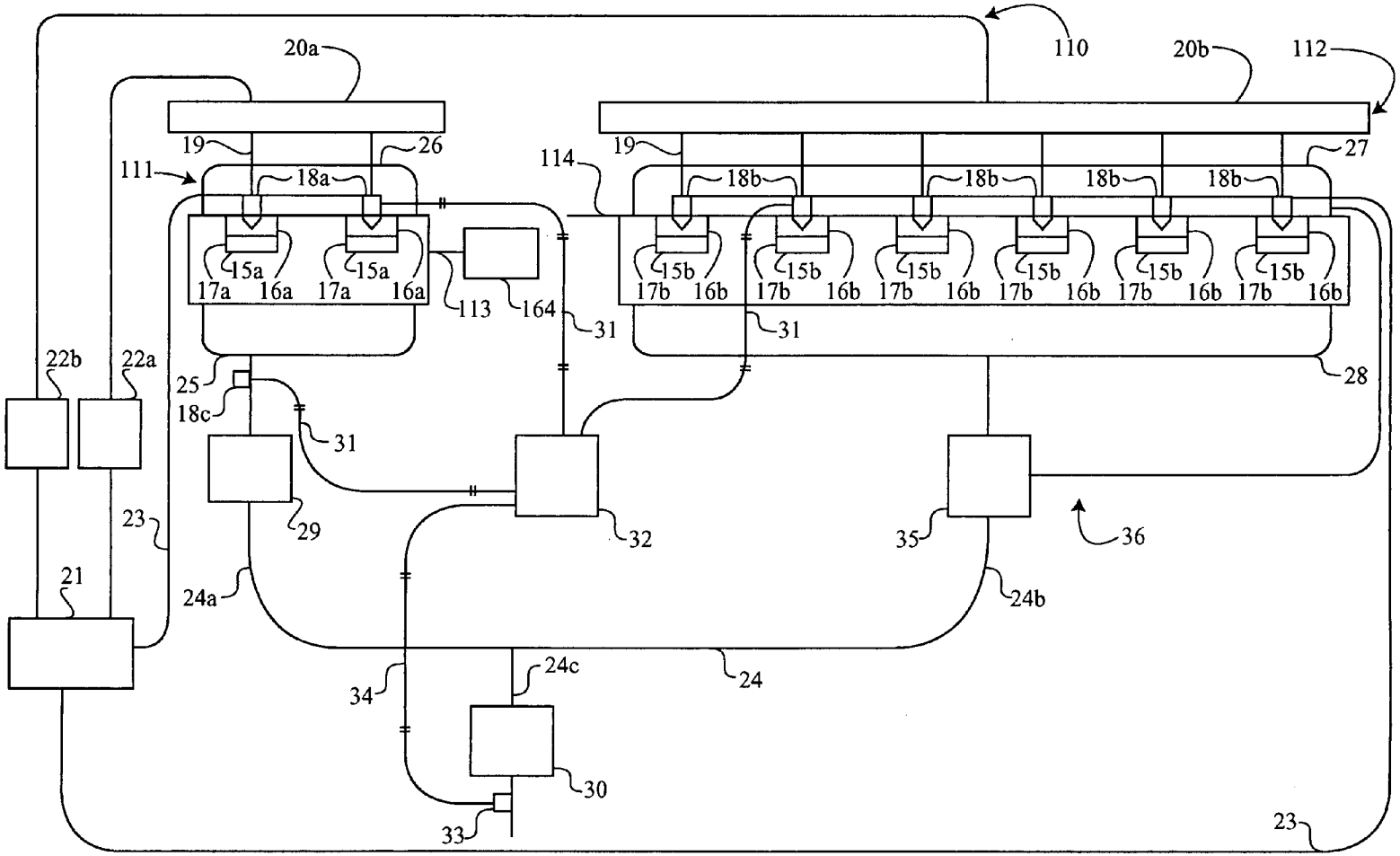
FIG. 2 is a schematic representation of the engine system, according to a second embodiment of the present disclosure.

Referring to FIG. 2, there is shown an engine system 110, according to a second embodiment of the present disclosure. The engine system 110 is similar to the engine system 10 of the first embodiment in that engine system 110 includes a low-displacement first engine 111 that is operable to produce exhaust with the high NOx concentration 65 and a high-displacement second engine 112 that is operable to produce exhaust with the low NOx concentration 37. However, in the second embodiment, a first power output 161 (illustrated in FIG. 6) of the first engine 111 is not coupled to a second power output 162 (illustrated in FIG. 6) of the second engine 112. Rather, a first output shaft 113 of the first engine 111 is coupled to an auxiliary apparatus 164, such as a pump. The first engine 111 can be mechanically, hydraulically or electrically coupled in any conventional manner to the auxiliary apparatus 164 such that the work of the first engine 111 is not wasted. Thus, the first engine 111 can power the secondary apparatus 164 while the second engine 112 powers the primary apparatus, such as a generator or a work machine. Those skilled in the art will appreciate that the first engine could be used to power a variety of different devices separate from the second engine, including but not limited to those discussed earlier in the text.

Figure 3:
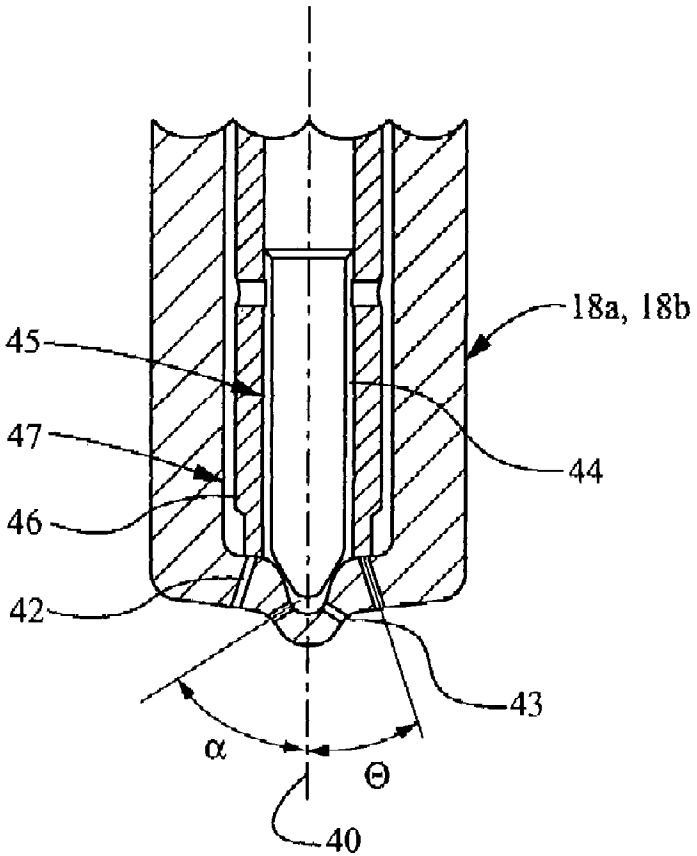
FIG. 3 is an enlarged sectioned side diagrammatic view of a tip portion of a mixed-mode fuel injector within the engine systems of FIGS. 1 and 2.
Figure 4:
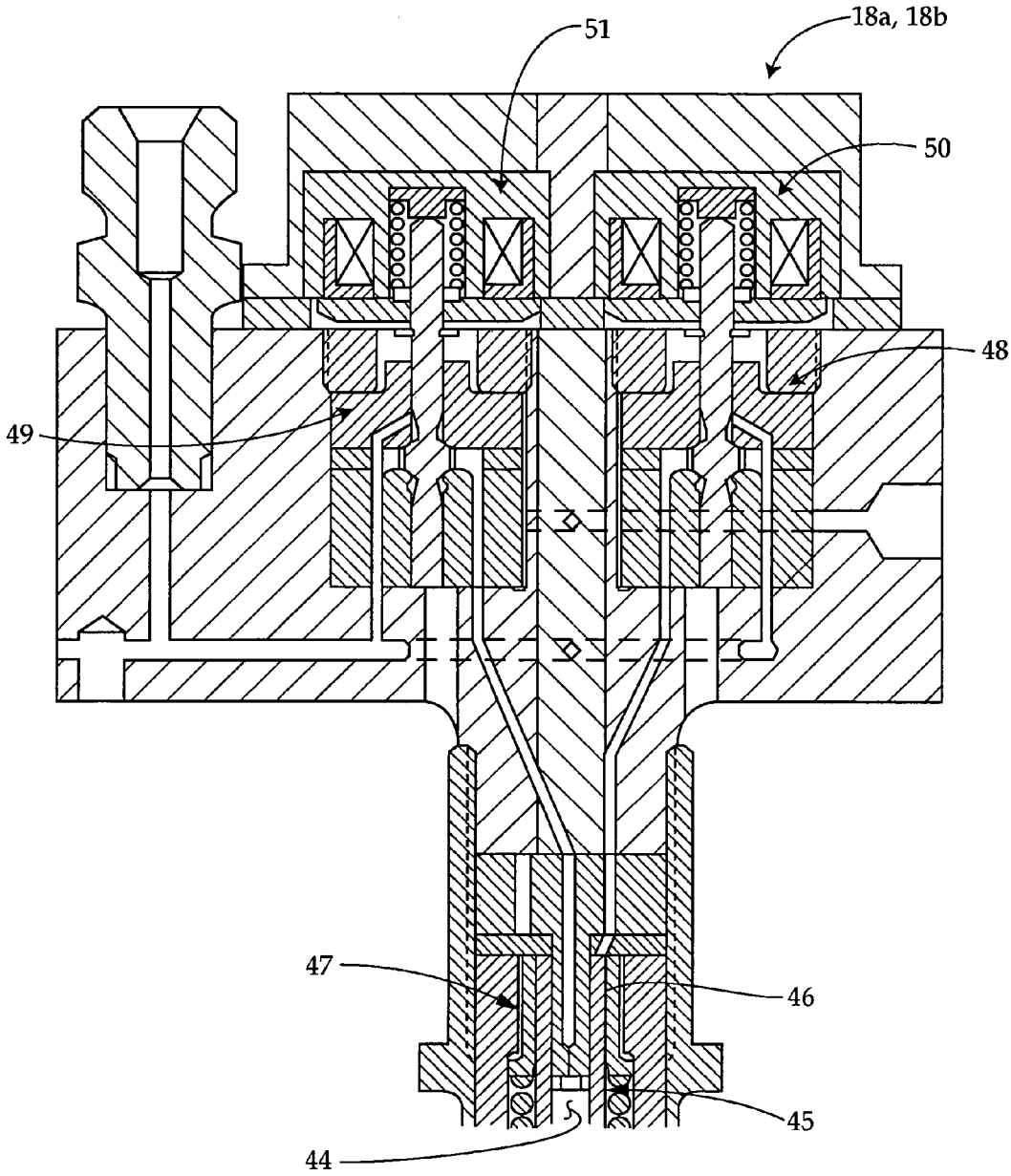
FIG. 4 is a sectioned side diagrammatic view of an upper portion of the mixed-mode fuel injector of FIG. 3.

Referring to FIG. 3, there is shown an enlarged sectioned side diagrammatic view of a tip portion of the fuel injectors 18*a*, 18*b* within the engine systems 10, 110 of FIGS. 1 and 2. Although any type of conventional fuel injector with only one set of nozzle outlets can be used, the fuel injector 18*a* may be a mixed-mode fuel injector that is operable to inject fuel in at least a first spray pattern (shown in FIG. 5) through a first nozzle outlet set 42 and a second spray pattern, which may be a conventional well known pattern for diffusion burns, through a second nozzle outlet set 43. Although not necessary, fuel injectors 18*b* may also be, and are illustrated as, mixed-mode fuel injectors. The first nozzle outlet set 42 is referred to as semi-homogenous or homogenous charge nozzle outlet set and has a relatively small average angle theta with respect to a centerline 40 of the combustion chambers 16*a* and 16*b*. These outlets may be relatively small and arranged in a showerhead pattern as shown in FIG. 4. Thus, the first spray pattern, referred to as a homogeneous charge spray pattern, includes a relatively small average angle theta with respect to the centerline 40 of the combustion chamber 16*a*, 16*b*. The second nozzle outlet set 43 is referred to as conventional nozzle outlet set typical of those in the art and has a relatively large average angle alpha with respect to the centerline 40. These outlets are typically associated with fuel injections in the vicinity of piston top dead center as is known in the art. The second spray pattern, referred to as a conventional spray pattern, includes a relatively large average angle alpha with respect to the centerline 40 of the combustion chamber 16*a*, 16*b*. The opening and closing of the second nozzle outlet set 43 and the first nozzle outlet set 42 may be controlled by an inner needle valve member 44 of a second direct control needle valve 47 and an outer needle valve member 46 of a first direct control needle valve 45, respectively. The fuel injectors 18*a*, 18*b* have the ability to controllably inject fuel through the first nozzle outlet set 42, the second nozzle outlet set 43, or both.

Referring to FIG. 4, there is shown a sectioned side diagrammatic view of an upper portion of the fuel injectors 18*a*, 18*b* of FIG. 3. A first and second needle control valves 48 and 49 control the positioning of the first and second direct control needle valves 45 and 47, respectively. Both needle control valves 48 and 49 operate in a similar manner and are preferably three-way valves that are substantially identical in structure. The first and second needle control valves 48 and 49 are operably coupled to a first and second electrical actuators 50 and 51, respectively. In order to open the first nozzle outlet set 42, the first electrical actuator 50 is energized, and the first needle control valve 48 moves to a position that relieves pressure acting on a closing hydraulic surface of the outer needle valve member 46. The outer needle valve member 46 can be lifted off its seat by high-pressure fuel within the injector 18*a*, 18*b*, and the fuel can be injected through the first nozzle outlet set 42. Similarly, in order to open the second nozzle outlet set 43, the second electrical actuator 51 is energized, moving the second needle control valve 49 to a position that relieves pressure acting on a closing hydraulic surface of the inner needle valve member 44. The inner needle valve member 44 can be lifted off its seat by high pressure fuel within the fuel injector 18*a*, 18*b* and inject the fuel through the second nozzle outlet set 43. Both the first and second electrical actuators 50 and 51 can be activated in various timings, including simultaneously, to inject fuel in different sequences and spray patterns. It should be appreciated that any fuel injector with the ability to inject fuel in more than one spray pattern may be considered a mixed-mode injector for use within the present disclosure regardless of the means for controlling the opening and closing of the different nozzle outlet sets.

Figure 5:
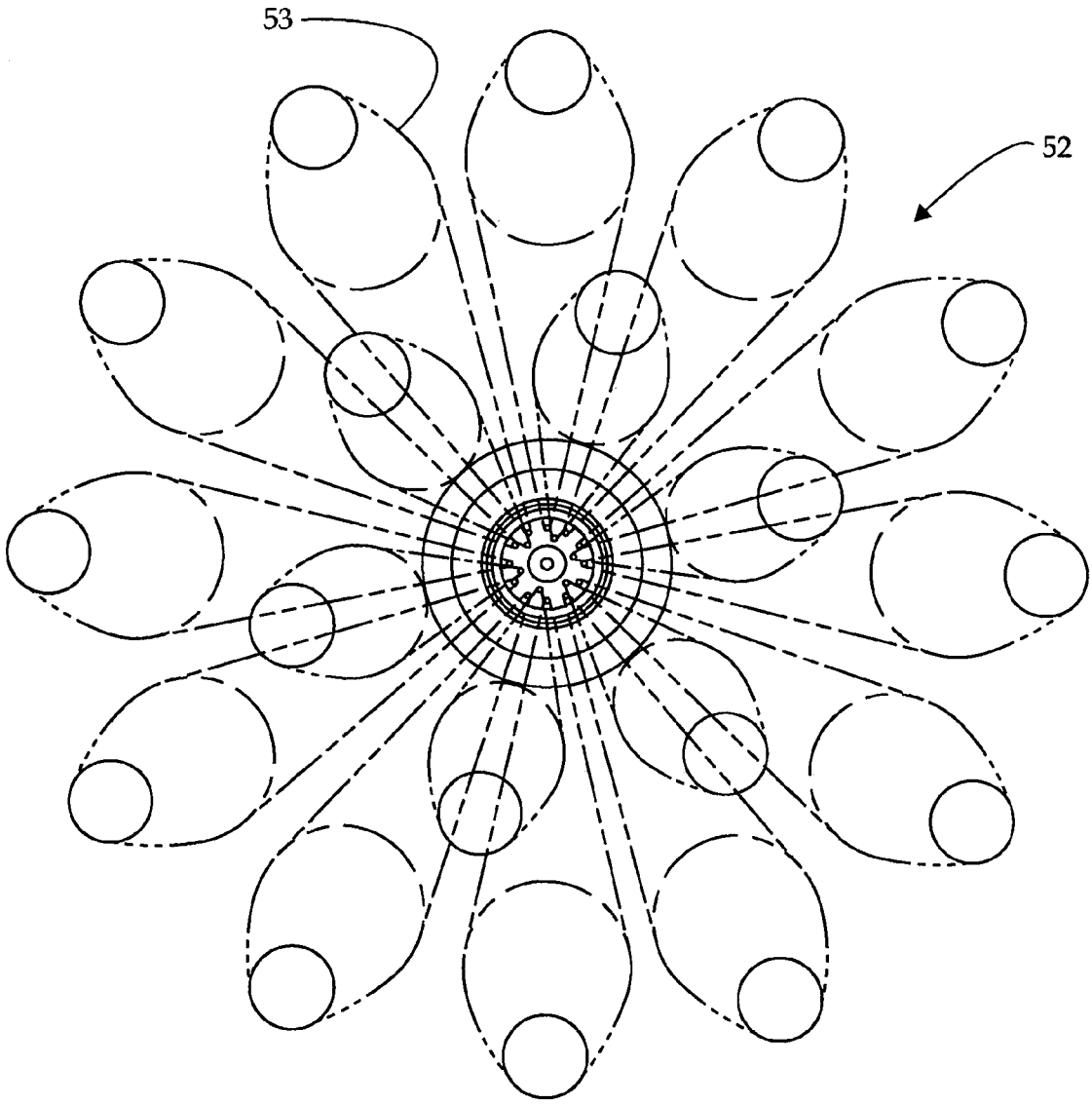
FIG. 5 is a bottom view of a first spray pattern from the mixed-mode fuel injector of FIG. 3.

Referring to FIG. 5, there is shown an example first spray pattern 52. The first spray pattern 52 is illustrated to include 18 nonintersecting plumes 53 that are directed downward with an average angle theta, as shown in FIG. 3. Average angle theta is preferably substantially small compared to the average angle alpha of the second spray pattern injected through the conventional nozzle outlet set 43. Generally, the engine piston 17*a*, 17*b* is farther away from top dead center during non-auto ignition conditions, rather than during auto-ignition conditions. Thus, in order to avoid spraying the walls of the cylinder 15*a*, 15*b* and the piston 17*a*, 17*b* during non-auto ignition conditions, fuel can be injected in the first spray pattern 52 with the relatively small average angle with respect to the centerline 40 of the combustion chamber 16*a*, 16*b*. If fuel is being injected in a conventional manner in auto-ignition conditions when the piston 17*a*, 17*b* is nearer to top dead center, fuel can be injected in the conventional second spray pattern with the relatively large average angle with respect to the centerline 40.

Figure 6:
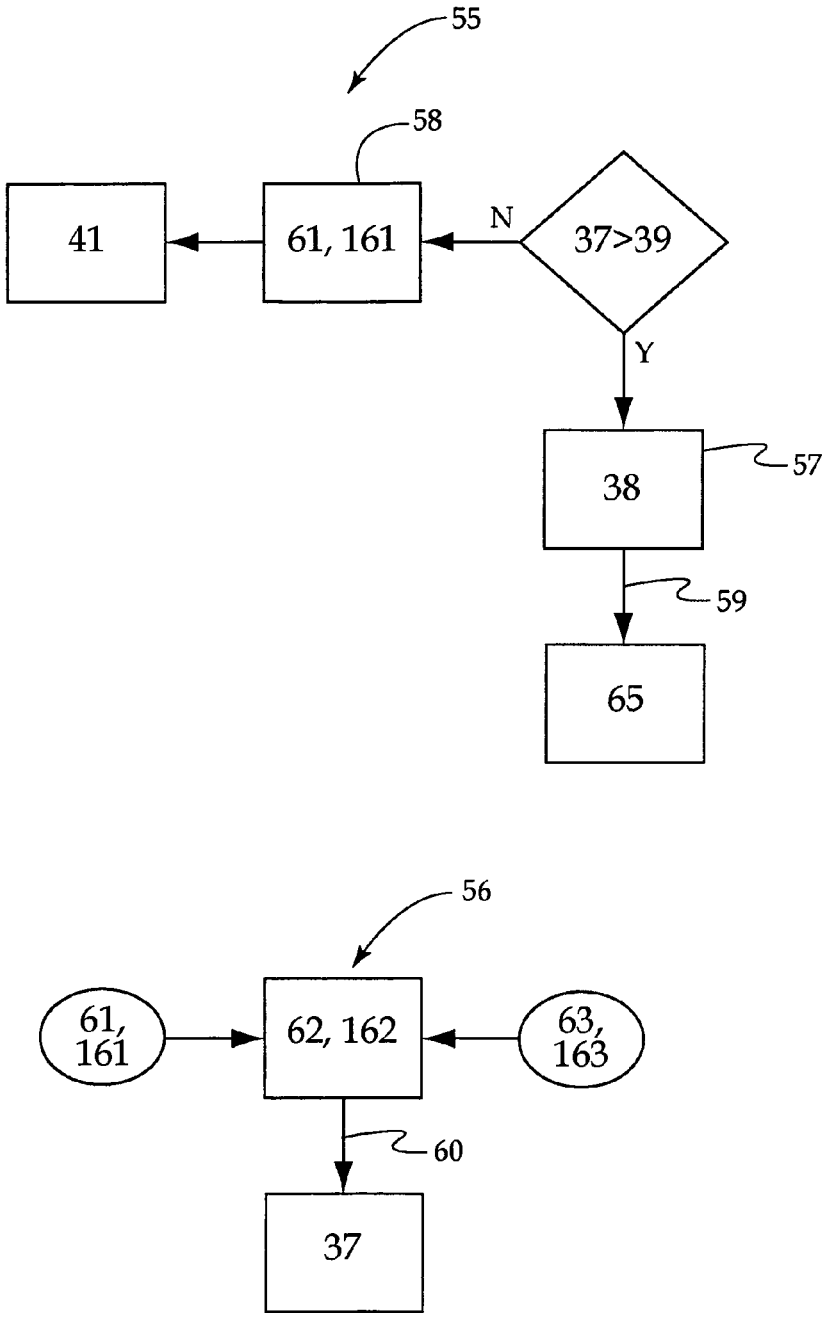
FIG. 6 is a flow chart of a high NOx generation algorithm and a low NOx generation algorithm, according to the first and second embodiments of the present disclosure.

Referring to FIG. 6, there is shown a flow chart of a high NOx generation algorithm 55 and a low NOx generation algorithm 56, according to both embodiments of the present disclosure. The electronic control module 32 includes the high NOx generation algorithm 55 in communication with the fuel injectors 18*a* of first engine 11, 111, and the low NOx generation algorithm 56 in communication with the fuel injectors 18*b* of the second engine 12, 112. It should be appreciated that the high NOx generation algorithm 55 may or may not run while the low NOx generation algorithm 56 is running. The high NOx generation algorithm 55 includes a first mode algorithm 57 that is operable to signal the first engine 11, 111 to produce the exhaust with the high NOx concentration 65 and a second mode algorithm 58 that is operable to signal the first engine 11, 111 to produce the exhaust with a decreased NOx concentration 41 when the low NOx concentration 37 from the second engine 12, 112 is less than a predetermined threshold NOx concentration 39. The predetermined threshold NOx concentration 39 is a NOx concentration within the exhaust from the second engine 12, 112 that is sufficiently low that the NOx need not be further reduced over the NOx selective catalyst 30 before being released into the atmosphere from the engine system 10, 110. The present disclosure contemplates any conventional closed loop and/or open loop means for determining the low NOx concentrations 37 being produced from the second engine 12, 112. In the illustrated embodiment, the low NOx concentration 37 within the exhaust from the second engine 12, 112 is determined, in part, from a map within the electronic control module 32 including expected low NOx concentrations for known engine operating conditions and/or the NOx sensor 33 positioned within the merged section 24*c* of the exhaust passage 24 and in communication with the electronic control module 32, and/or additional NOx sensors in passages 24*a* and 24*b*.

The first mode algorithm 57 of the high NOx generation algorithm 55 is operable to signal the fuel injectors 18*a* of the first engine 11, 111 to inject fuel in a predetermined high NOx injection sequence 59. The predetermined high NOx generation sequence 59 is based, in part, on an ammonia production amount 38 that is operable to reduce the low NOx concentration 37 within the exhaust from the second engine 12, 112. The ammonia production amount 38 is the amount of ammonia needed to convert the low NOx concentration 37 in the second section 24*b* of the exhaust passage 24 to harmless gasses. The high NOx generation algorithm 55 will set the timing and amounts of the injections within the predetermined high NOx generation sequence 59 to generate the high NOx concentration 65 from the combustion chambers 16*a* that corresponds to the ammonia production amount 38. Those skilled in the art will appreciate that the NOx to ammonia conversion within the first section 24*a* of the exhaust passage 24 is about 1:1.

Preferably, the predetermined high NOx sequence 59 includes a first injection in a non-auto ignition condition and a second injection in an auto-ignition condition within the combustion chambers 16*a* in the same engine cycle. It should be appreciated that the predetermined high NOx generation sequence 59 could include additional early or late injections. Those skilled in the art will also appreciate that auto-ignition conditions within each combustion chamber 16*a* generally occur when the engine piston 17*a* is relatively close to top dead center of a compression or expansion stroke, and non-auto ignition conditions generally occur when the engine piston 17*a* is relatively far from top dead center of the compression or expansion stroke. Thus, the first fuel injection will mix with air within each combustion chamber 16*a* as the engine piston 17*a* advances before igniting. The second injection will ignite upon injection during or shortly after combustion of the first injection. Generally, the apportioning of the injected fuel between the first and second injections will vary for different engine speeds and loads. Around mid-range engine speed and 50-75% loads, the first and second injections will each include about 50% of the amount of fuel being injected into the combustion chamber 16*a* each engine cycle. As the engine load and speed decreases below the mid-speed and load range, more fuel will be apportioned from the second injection to the first injection. At the lowest speeds and loads, the first injection could include 80% or more of the fuel being injected. As the engine load and speed increases above the mid-speed and load range, more fuel will be apportioned from the first injection to the second injection. At the highest speeds and loads, the second injection could include about 80% or more of the fuel being injected. Although the predetermined high NOx generation sequence 59 can be used to create either rich or lean combustion conditions, preferably the predetermined high NOx generation sequence 59 of the high NOx generation algorithm 55 creates slightly lean combustion conditions. Those skilled in the art will appreciate that lean combustion conditions exist when lambda is less than one. Lambda is the air-to-fuel ratio divided by stoichiometric air-to-fuel ratio. In the illustrated example, the exhaust created by the high NOx generation sequence 59 has a lambda of about 1.3.

Although the present disclosure contemplates use with a conventional fuel injector with only one set of nozzle outlets through which the first and second injections occur, preferably the mixed-mode fuel injectors 18*a* inject the first injection in the first spray pattern and the second injection in the second spray pattern. Because the first injection occurs during non-auto ignition conditions within each combustion chamber 16*a*, the relatively small angle of the injection will allow the fuel to be injected within the open space of the combustion chamber 16*a* rather than on the walls of the cylinder 15*a*. Because the second injection occurs during auto-ignition conditions, the second injection will ignite upon injection. Thus, the first charge will inherently have ignited before the second injection occurs, and the second injection can be injected at a relatively large angle with respect to the centerline 40 as compared with the first injection.

The second mode algorithm 58 of the high NOx generation algorithm 55 is operable to signal the fuel injectors 18*a* to inject fuel into the combustion chambers 16*a* in any manner known in the art that produces the decreased NOx concentration 41. For purposes of the instant discussion, the decreased NOx concentration 41 is a NOx concentration less than the high NOx concentration 65 created by the first mode algorithm 57 of the high NOx algorithm 55. Because the second mode algorithm 58 only operates when the low NOx concentration 37 from the second engine 12 is less than the predetermined threshold NOx concentration 39, the injection sequence of the second mode algorithm 58 need not produce the high NOx concentration 65 required to create the ammonia. Thus, the injection strategy of the second mode algorithm 58 is, in part, based in a conventional manner, on the desired power output 61, 161 of the first engine 11, 111. The present disclosure contemplates the electronic control module 32 including a map with the desired power outputs 61, 161, and known injection strategies to achieve the desired power output 61, 161. Those skilled in the art will appreciate that conventional injection strategies generally create the decreased NOx concentration 41. For instance, it is known that a single injection after top dead center may create the decreased NOx concentration 41 at certain known engine speeds and loads. Those skilled in the art will appreciate that the mixed mode fuel injector 18*a* will provide more variability in and control over the injection strategies used to create the decreased NOx concentration 41 at various engine speeds and loads. The use of mixed-mode fuel injectors 18*a* will provide the ability to inject more fuel in the first injection and to inject earlier in the engine cycle. The predetermined injection strategies of the second mode algorithm 58 may or may not be similar to a predetermined low NOx generation injection strategy 60 of the low NOx generation algorithm 56.

The low NOx generation algorithm 56 is operable to signal the fuel injectors 18*b* of the second engine 12 to inject fuel in the predetermined low NOx generation sequence 60. The predetermined low NOx generation sequence 60 is based, in part, on a desired power output 63, 163 of the engine system 10, 110. The desired power output 63, 163 is a product of both the first power output 61, 161 and the second power output 62, 162, although the second power output 62, 162 from the second engine 12, 112 provides the majority of the desired power output 63, 163 of the engine system 10, 110. The low NOx generation algorithm 56 is operable to determine the second power output 62, 162 needed to achieve the desired power output 63, 163. Those skilled in the art will appreciate that the low NOx generation sequence 60 could include various injection strategies known to produce low NOx concentration 37 at various engine-operating conditions. The electronic control module 32 may include a map including the predetermined low NOx generation sequence 60 including injection timings and amounts corresponding to the second power output 62, 162. Preferably, the predetermined low NOx generation sequence 60 creates lean combustion conditions. In the illustrated example, the combustion conditions created by the predetermined low NOx generation sequence 60 are leaner than the combustion conditions created by the predetermined high NOx generation sequence 59. Although lambda of the exhaust from the second engine 12, 112 can vary, generally the exhaust will have a lambda of about three.

Although the predetermined low NOx generation sequence 60 can vary, the low NOx generation sequence 60 is illustrated as including a first injection during non-auto ignition conditions and a second injection during auto ignition conditions. Similar to the predetermined high NOx generation sequence 59, the first injection may be in the first spray pattern 52 and the second injection may be in the second spray pattern. However, the second injection of the low NOx generation sequence 60 may be injected later in the engine cycle than the second injection of the high NOx generation sequence 59. Generally, the second injection of the low NOx generation sequence 60 will be injected after top dead center of the compression stroke. By retarding the second injection, the combustion chambers 16*b* have time to cool after the combustion of the first injection. It has been found that injecting a second amount of fuel into a cooler combustion chamber 16*b* creates less NOx than injecting into a hot combustion chamber 16*a*. Further, the apportioning of the fuel between the first and second injections in the predetermined low NOx generation sequence 60 is different than in the predetermined high NOx generation sequence 59. More of the fuel injected in each engine cycle will be injected in the first injection of the high NOx generation sequence 59 than will be injected in the first injection of the low NOx generation sequence 60. The timing and apportioned amounts of the first and second injections may vary based on the desired second power output 62, 162 in a similar manner as the injections of the high NOx generations sequence 59. Although a predetermined low NOx generation sequence 60 has been described with a first and second injection, it should be appreciated that the low NOx generation sequence 60 can include any number of injections, including a single injection in the vicinity of top dead center of the compression stroke.

The NOx concentration 37 produced by the operation of the second engine 12 producing the majority of the desired power output 63, 163 will be reduced in the merged section 24*c* of the exhaust passage 24 by the ammonia produced in the first section 24*a* of the exhaust passage 24. It should be appreciated that the NOx concentration 37 being produced by the second engine 12 could be increased in order to match the ammonia production 38 rather than the ammonia production 38 being reduced.

INDUSTRIAL APPLICABILITY

Referring to FIGS. 1-6, a method of operating the engine system 10, 110 will be discussed according to the first and second embodiments of the present disclosure. Although the present disclosure will be discussed for the engine system 10, 110 including two mixed-mode fuel-injected internal combustion engines 11 and 12, it should be appreciated that the present disclosure contemplates use with various types of engines and various types of fuel injectors, including a conventional fuel injector with one set of nozzle outlets.

The second engine 12, 112 generates exhaust with the low NOx concentration 37 preferably by injecting fuel in the predetermined low NOx generation sequence 60 based, in part, on the desired power output 63, 163 of the engine system 10, 110. In both embodiments, the second engine 12, 112 is a high displacement engine coupled to the primary apparatus, such as a drive shaft and/or a hydraulic implement of a work machine. The power output from each cylinder 15*b* in the second engine 12, 112 will be more than the power output from each cylinder 15*a* in the first engine 11, 111 at least in part because the second engine 12 is turbocharged. Thus, the second engine 12, 112 is primarily creates the power for work. The low NOx generation algorithm 56 will sense and determine the desired power output 63, 163 of the engine system 10, 110 in any conventional manner known in the art. The low NOx generation algorithm 56 will then determine the portion of the desired power output 63, 163 that is generated by the second power output 62, 162 of the second engine 12. In the first embodiment, the second power output 62 will be the percentage of the power supplied by the second engine 12 to power the primary apparatus. In the second embodiment, the second power output 162 will be the total power needed to operate the primary apparatus. The low NOx generation algorithm 56 can set the predetermined NOx generation injection sequence 60 including injection timings and amounts to generate the second power output 62, 162. Those skilled in the art will appreciate that various conventional injection strategies, including a single fuel injection after top dead center of the compression stroke, will produce the low NOx concentration 37.

In the illustrated embodiment, the predetermined low NOx generation sequence 59 includes the first injection during non-auto ignition conditions and the second injection during auto-ignition conditions. The low NOx generation algorithm 56 will signal the fuel injections 18*b* of the second engine 12, 112 to inject the first injection approximately between 80°-40° before top dead center of the compression stroke. The higher the desired second power output 62, 162, the less fuel injected during each engine cycle apportioned to the first injection. However, the proportion of fuel being injected through the first injection is generally less in the low NOx generation sequence 60 than in the high NOx generation sequence 59. As the engine pistons 17*b* advance during the compression or expansion stroke, the first injection will mix with the air and eventually combust. The relatively homogenous combustion of the first injection will create very low NOx concentrations. The low NOx generation algorithm 56 will signal the fuel injectors 18*b* to inject the second injection slightly after top dead center of the compression or expansion stroke. Thus, the combustion chambers 16*b* will have cooled before the second injection, thereby limiting the NOx produced by the second injection. At high engine speeds and loads, the majority of the fuel may be injected through the second injection.

In order to reduce the low NOx concentration 37 within the exhaust from the second engine 12, 112, the first engine 11, 111 generates exhaust with the high NOx concentration 65 preferably by injecting fuel in a predetermined high NOx generation sequence 59. The predetermined high NOx generation sequence 59 is based, in part, on the ammonia production amount 38 needed to reduce the low NOx concentration 37 within the exhaust from the second engine 12, 112 to harmless gasses. If the low NOx concentration 37 within the exhaust from the second engine 12, 112 is less than the predetermined threshold NOx concentration 39, the ammonia production amount 38 needed to reduce the NOx within the second engine exhaust is minimal. Those skilled in the art will appreciate that there are certain low-power situations, such as idle, in which the NOx concentration 37 in the exhaust from the second engine 12, 112 is so low that it need not be further reduced by the NOx selective catalyst 30. Thus, the second mode algorithm 57 of the high NOx generation algorithm 55 will signal the first engine 11, 111 to provide the first power output 16, 161 while producing exhaust with the decreased NOx concentration 41. Alternatively, during prolonged idle, the second engine 12, 112 could be shut down while any needed power could be provided by the first engine 11, 111 operating in low NOx mode.

Although the present disclosure contemplates various methods of decreasing the NOx concentration within the exhaust from the first engine 11, such as ceasing operation of the first engine 11, 111, the fuel injectors 18*a* could inject fuel in predetermined NOx injection strategies to create various first power outputs 61, 161. Those skilled in the art will appreciate that conventional injection strategies produce less NOx than the known high NOx injection sequence 59. For instance, injecting once or more in the vicinity of top dead center of the compression stroke can create the decreased NOx concentration 41 while also creating the first power output 61, 161. Moreover, the second mode algorithm 57 could inject fuel in the illustrated predetermined low NOx generation sequence 60 including the first injection during non-auto ignition conditions and the second injection during auto-ignition conditions and after the combustion chambers 16*a* have cooled. Using a conventional fuel injector, the first injection can be injected around 40° before top dead center of the compression or expansion stroke. Using the mixed-mode fuel injectors 18*a*, the first injection can occur earlier, such as 80° or 60° before top dead center. At lower desired first power output 61, 161, more fuel can be apportioned to the first injection and the first injection can occur earlier in the engine cycle. Regardless of whether a conventional or mixed-mode fuel injector 18*a* is used, the second injection generally occurs after top dead center. Because the NOx concentration 37 is less than the predetermined NOx concentration 39, there is no need to further reduce the NOx concentration 37 with ammonia, and thus, no need to operate the first engine 111, 11 in a manner to create the high NOx concentration 65.

If the low NOx concentration 37 within the exhaust from the second engine 12, 112 is greater than the predetermined threshold NOx concentration 39, the first mode algorithm 56 of the high NOx generation algorithm 55 will signal the first engine 11, 111 to produce exhaust with the high NOx concentration 65 corresponding to the ammonia production amount 38 operable to reduce the low NOx concentration 37 from the second engine 12, 112. Those skilled in the art will appreciate that the high NOx concentration 65 can be set by either a closed or open loop system. In the illustrated embodiment, expected low NOx concentrations at various engine operating conditions are predetermined and included within a map in the electronic control module 32. Each expected low NOx concentration would have a corresponding high NOx concentration 65 from the combustion chambers 16*a*. The map can include the predetermined amount and timing of each injection to achieve the high NOx concentration 65 at the sensed engine operation conditions. For instance, the map could include the high NOx generation sequence 59 with the first injection occurring about 60 before top dead center of the compression stroke and the second injection occurring about 20° before top dead center. These maps can be fine-tuned on-board with appropriate sensing combined with a closed loop control algorithm.

In addition to the predetermined map, the NOx sensor 33 may be used to sense the NOx concentration and/or ammonia concentration within the exhaust downstream from the NOx selective catalyst 30. If the NOx concentration exceeds a predetermined NOx concentration, the high NOx generation algorithm 55 can determine that there is insufficient ammonia to reduce all of the NOx within the merged section 24*c*, and adjust the high NOx concentration 65 from the first engine 11 to correspond to the ammonia production amount 38 that is needed to reduce the low NOx concentration 37. In order to increase the high NOx concentration 65, those skilled in the art will appreciate that the timing and the amounts of the first and second injections within the predetermined high NOx generation injection sequence 59, including the first injection about 60° before top dead center and the second injection about 20° before top dead center of the compression or expansion stroke, can be adjusted. For instance, to increase the NOx concentration 65 while maintaining the slightly lean combustion environment, the timing of the first injection can be advanced and/or the some of the fuel injected in the second injection can be re-apportioned to the first injection.

If the NOx sensor 33 senses an ammonia concentration in the exhaust that exceeds a predetermined ammonia concentration, the high NOx generation algorithm 55 may determine that there is more ammonia being produced that necessary to reduce the low NOx concentration 37. The high NOx generation algorithm 55 will reduce the high NOx concentration 65 from the first engine 11 to correspond to a reduced ammonia production amount 38. Those skilled in the art will appreciate that the NOx concentration 65 can be reduced by adjusting the timing and/or amounts of the first injection and the second injection of the predetermined high NOx generation injection sequence 59, including the first injection about 60° before top dead center and the second injection at about 20 before top dead center. For instance, while maintaining the slightly lean environment, the timing of the second injection can be retarded and/or some of the fuel injected in the first injection can be re-apportioned to the second injection. Although the present disclosure illustrates the ammonia production amount 38 being based on the predetermined low NOx concentrations 37 from the map and the sensed NOx and ammonia concentrations by the sensor 33, it should be appreciated that the ammonia production amount 38 could be determined based on solely the map or the sensed concentrations. Regardless of the procedure for setting the high NOx concentration 65, the present disclosure can assure that the ammonia produced within the first section 24*a* of the exhaust passage 24 will reduce the NOx concentration 37 within the second section 24*b* such that very little, if any, NOx and ammonia are present in the exhaust downstream from the NOx selective catalyst 30.

During each engine cycle, the first fuel injection of the high NOx generation sequence 59 occurs during non-auto ignition conditions within the combustion chambers 16*a*. Preferably, the timing of the first injection will be sufficiently early within the engine cycle to allow some mixing of the fuel with the air before ignition. Thus, the first injection is referred to as a semi-homogeneous injection that creates a high NOx generating environment within the combustion chambers 16*a*. Although the timing of the injection can vary, the first injection may occur generally as early as about 80° before top dead center of the compression stroke in the preferred embodiment with the mixed-mode fuel injectors 18*a*. Because the first injection is preferably injected in the second spray pattern 52 shown in FIG. 4, the fuel will spray at a relatively small average angle with respect to the centerline 40 of the combustion chambers 16*a*, thereby reducing the risk of spraying the walls of the cylinders 15*a* and the pistons 17*a*. However, with the conventional fuel injector, the fuel will be injected in the conventional spray pattern with the relatively large angle with respect to the centerline 40. In order to avoid spraying the walls of the cylinder 15*a* and the pistons 17*a*, the first injection from the conventional fuel injector will occur generally between 40-60° before top dead center of the compression stroke. Thus, with the mixed-mode injection the first injection can occur earlier and can include more fuel than with a conventional injector without risking dilution of engine lubricating oil due to wall wetting, allowing more time for the fuel within the first injection to mix with the air in the cylinders 15*a*. Generally, the first injection will include 20-80% of the total amount of fuel injected in each engine cycle, with 20% being at the high engine speeds and loads and 80% being at the low engine speeds and loads. Regardless of whether a conventional or the preferred mixed-mode fuel injection 18*a* is used, because the first injection occurs during non-auto ignition conditions, the fuel within the combustion chambers 16*a* will have time to mix with the air prior to ignition.

As each engine piston 17*a* advances during the compression stroke, the fuel from the first fuel injection will combust. Generally, the first fuel injection will combust around 20-25° before top dead center of the compression stroke. Preferably soon after combustion of the first fuel injection while the combustion chamber 16*a* is relatively hot, the high NOx generating algorithm 55 will signal the fuel injectors 18*a* to inject in the second spray pattern, being the conventional spray pattern. The second electrical actuators 51 will be activated, thereby lifting the inner direct needle valve members 44 off of its seat and opening the conventional nozzle outlet sets 43. Regardless of whether the fuel injector is the preferred mixed mode injector 28*a* or a conventional injector, the fuel will be injected at a relatively small angle with respect to the centerline 40 of the combustion chambers 16*a*. It has been found that the combination of the semi-homogeneous first injection followed by the conventional second injection creates a greater NOx concentration within the exhaust than either of the first or second injections alone.

As each engine piston 17*a* retracts during an expansion stroke and/or advances during an exhaust stroke, each combustion chamber 16*a* will return to a non-combustible environment. In the illustrated embodiment, the electronic control module 32 preferably will signal the fuel injectors 18*a* to inject an additional amount of fuel in the non-combustible environment during at least one of the expansion stroke and an exhaust stroke. Those skilled in the art will appreciate that each engine piston 17*a* will be at a relatively substantial distance from top dead center of the compression stroke when the combustion chamber 16*a* is in the non-combustible environment. Thus, the fuel injectors 20*a* will preferably inject the fuel in the first spray pattern 52, thus avoiding spraying the pistons and cylinder walls. The advancing pistons 17*a* during the exhaust stroke will push the exhaust with the high NOx concentration 65 and the additional unburnt fuel amount out of the combustion chambers 16*a* and into the first exhaust manifold 25 via an open exhaust valve. This unburnt fuel can create the rich exhaust conditions desirable for NOx to ammonia conversion without the need for the additional fuel injector 18*c* within the exhaust passage 24*a*. However, in the embodiments illustrated in FIGS. 1 and 2, unburnt fuel is added to the exhaust by injecting the fuel into the first section 24*a* of the exhaust passage 24 downstream from the combustion chambers 16*a*. The electronic control module 32 can signal the additional fuel injectors 18*c* to inject the additional amount of fuel in order to create the rich conditions desirable for NOx to ammonia conversion over the ammonia-producing catalyst 29. It should be appreciated that the rich exhaust conditions can be created by other methods, such as injecting more fuel within the predetermined high NOx generation sequence 59. Although the predetermined high NOx generation sequence 59 can create rich conditions within the exhaust from the first combustion chambers 16*a*, preferably the predetermined high NOx generation sequence 59 creates slightly lean combustion conditions. The exhaust with the high NOx concentration 65 is passed over the ammonia-producing catalyst 29. In the rich conditions created by the additional amount of unburnt fuel, the NOx to ammonia conversion within the first section 24*a* of the exhaust passage 24 is approximately 1:1.

The exhaust from the first engine 11, 111 with the ammonia is merged in the merged section 24*c* of the exhaust passage 24 with the exhaust from the second engine 12, 112. The merged exhaust is passed over the NOx selective catalyst 30 positioned within the merged section 24*c*. Those skilled in the art will appreciate that the NOx selective catalyst 29 uses the ammonia, and any other related reductants within the exhaust, to reduce the NOx to harmless gases, such as nitrogen, that are emitted in the exhaust.

The present disclosure is advantageous because it provides an on-board generation of ammonia for reduction of NOx without compromising the power output or performance of the engine system 10, 110. By providing an engine system 10, 110 with two engines 11, 111 and 12, 112, one engine 12, 112 can primarily operate in a manner designed to meet the desired power output 63, 163 of the system 10, 110 while the other engine 11, 111 can primarily operate in manner to aid in the exhaust purification of the engine system 10, 110. For instance, the power output 62, 162 of the second engine 12, 112 can be enhanced by methods known in the art, such as turbochargers, without creating engine vibrations associated with a power imbalance between cylinders of one engine. Moreover, the power output 61, 161 of the first engine 11, 111 will not be wasted, but rather added to the combined power output 63 used to power the primary apparatus, such as the work machine or generator, or used to power an auxiliary apparatus 164, such as a pump. Thus, the engine system 10, 110 of the present disclosure may be powerful and operate relatively smoothly while also producing low NOx emissions.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. An engine system comprising:

a first engine being operable to produce a high NOx concentration exhaust and a second engine being operable to produce a low NOx concentration exhaust;

an exhaust passage including a first section being fluidly connected to the first engine, a second section being fluidly connected to the second engine, and a merged section being downstream from, and fluidly connected to, the first section and the second section;

the first engine including a combustion chamber and a fuel injector configured to inject fuel within the combustion chamber in a high NOx sequence that includes a first injection and a second injection in a same engine cycle of the first engine.

2. The engine system of claim 1 including at least one electronic control module including a high NOx generation algorithm in communication with the first engine, and a low NOx generation algorithm in communication with the second engine; and the combustion chamber of the first engine changing between an non-auto-ignition condition and an auto-ignition condition in each engine cycle.

3. The engine system of claim 2 wherein a first power output of the first engine and a second power output of the second engine are coupled to a common power output.

4. The engine system of claim 3 wherein the first engine includes an output shaft coupled to an output shaft of the second engine.

5. The engine system of claim 2 including a reductant-producing catalyst positioned in the first section of the exhaust passage, and a NOx selective-catalyst positioned in the merged section of the exhaust passage.

6. The engine system of claim 2 wherein at least the second engine includes a forced-induction system.

7. The engine system of claim 2 wherein the first engine includes a low displacement engine, and the second engine includes a high displacement engine.

8. The engine system of claim 2 wherein the electronic control module includes a first mode algorithm operable to signal the first engine to produce the high NOx concentration exhaust and a second mode algorithm operable to signal the first engine to produce a decreased NOx concentration exhaust when the low NOx concentration within the exhaust from the second engine is less than a predetermined threshold NOx concentration.

9. The engine system of claim 2 wherein the second engine includes at least one fuel injector partially positioned within at least one combustion chamber.

10. The engine system of claim 9 wherein the first engine includes at least one fuel injector partially positioned within at least one combustion chamber.

11. An engine system comprising:

a first engine being operable to produce a high NOx concentration exhaust and a second engine being operable to produce a low NOx concentration exhaust;

an exhaust passage including a first section being fluidly connected to the first engine, a second section being fluidly connected to the second engine, and a merged section being downstream from, and fluidly connected to, the first section and the second section;

at least one electronic control module including a high NOx generation algorithm in communication with the first engine, and a low NOx generation algorithm in communication with the second engine;

wherein the second engine includes at least one fuel injector partially positioned within at least one combustion chamber;

wherein the first engine includes at least one fuel injector partially positioned within at least one combustion chamber;

wherein the high NOx generation algorithm being operable to signal the at least one fuel injector of the first engine to inject fuel in a predetermined high NOx generation sequence including a first injection in a non-auto ignition condition and a second injection in an auto-ignition condition; and the low NOx generation algorithm being operable to signal the at least one fuel injector of the second engine to inject fuel in a predetermined low NOx generation sequence.

12. The engine system of claim 11 wherein the high NOx generation algorithm being operable to create relatively lean combustion conditions.

13. An engine system comprising:

a first engine being operable to produce a high NOx concentration exhaust and a second engine being operable to produce a low NOx concentration exhaust;

an exhaust passage including a first section being fluidly connected to the first engine, a second section being fluidly connected to the second engine, and a merged section being downstream from, and fluidly connected to the first section and the second section;

at least one electronic control module including a high NOx generation algorithm in communication with the first engine, and a low NOx generation algorithm in communication with the second engine;

wherein the second engine includes at least one fuel injector partially positioned within at least one combustion chamber;

wherein the first engine includes at least one fuel injector partially positioned within at least one combustion chamber;

wherein at least the fuel injector of the first engine includes a mixed-mode fuel injector being operable to inject fuel in a first spray pattern with a small average angle relative to a centerline of the combustion chamber and a second spray pattern with a large average angle relative to the centerline of the combustion chamber;

wherein the high NOx generation algorithm being operable to signal the at least one fuel injector of the first engine to inject fuel in a predetermined high NOx generation sequence including a first injection in a non-auto ignition condition and a second injection in an auto-ignition condition; and the low NOx generation algorithm being operable to signal the at least one fuel injector of the second engine to inject fuel in a predetermined low NOx generation sequence.

14. The engine system of claim 13 wherein the predetermined high NOx generation sequence includes at least a first injection during non-auto ignition conditions in the first spray pattern and a second injection during auto-ignition condition in the second spray pattern.

15. Then engine system of claim 14 wherein the first engine includes low displacement engine with an output shaft coupled to an output shaft of the second engine including a high displacement engine;

at least the second engine includes a forced-induction system;

the electronic control module including a first mode algorithm operable to produce the high NOx concentration exhaust and a second mode algorithm operable to produce a decreased NOx concentration exhaust when the low NOx concentration within the exhaust from the second engine is less than a predetermined threshold NOx concentration, and the high NOx generation algorithm being operable to create relatively lean combustion conditions; and a reductant-producing catalyst being positioned in the first section of the exhaust passage, and a NOx selective-catalyst being positioned in the merged section of the exhaust passage.

16. A method of operating an engine system, comprising:

generating exhaust with a high NOx concentration from a first engine by injecting fuel within a combustion chamber in a high NOx generation sequence that includes a first injection and a second injection in a same engine cycle;

generating exhaust with a low NOx concentration from a second engine; and merging the exhaust from the first engine with the exhaust from the second engine.

17. The method of claim 16 including the steps of passing the exhaust from the first engine over a reductant-producing catalyst; and passing merged exhaust from the first and second engines over a NOx selective catalyst.

18. The method of claim 16 including a step of coupling a first power output of the first engine and a second power output of the second engine to a common power output.

19. The method of claim 16 wherein the step of generating the exhaust with the low NOx concentration includes a step of injecting fuel in a predetermined low NOx generation sequence, at least in part, based on a desired power output of the engine system.

20. The method of claim 19 wherein the step of generating the exhaust with the high NOx concentration includes a step of injecting fuel in a predetermined high NOx generation sequence, at least in part, based on an ammonia production amount operable to reduce the low NOx concentration with the exhaust from the second engine; and performing the first injection during a non-auto-ignition condition, and performing the second injection during an auto-ignition condition.

* * * * *